United States Patent [19]

Thornton

[11] 3,948,395

[45] Apr. 6, 1976

[54] INDEXING TAB FOR SORTING DEVICE

[76] Inventor: Kenneth E. Thornton, 18231 SE. McLoughlin Blvd., Portland, Oreg. 97222

[22] Filed: Sept. 27, 1974

[21] Appl. No.: 510,043

[52] U.S. Cl. ..... 211/11; 40/73.2

[51] Int. Cl.[2] ..... B42F 21/00

[58] Field of Search ..... 211/11, 10, 45, 50; 40/73.2, 78, 104.03, 104.13

[56] References Cited

UNITED STATES PATENTS

| | | | |
|---|---|---|---|
| 1,672,764 | 6/1928 | Kreiling | 211/11 |
| 2,273,662 | 2/1942 | Ralston | 211/11 |
| 2,429,349 | 10/1947 | Evans | 211/11 |
| 2,581,730 | 1/1952 | Talmage et al. | 211/11 |
| 2,876,907 | 3/1959 | Amberg | 211/11 |
| 3,000,509 | 9/1961 | Larter | 211/11 |
| 3,184,067 | 5/1965 | Larter | 40/104.03 X |

*Primary Examiner*—Roy D. Frazier
*Assistant Examiner*—Robert W. Gibson, Jr.
*Attorney, Agent, or Firm*—Kolisch, Hartwell, Dickinson & Stuart

[57] ABSTRACT

The present invention relates to an indexing tab for use with a sorting device including a plurality of sheet, or plate-like, divider leaves. The tab is secured to the free end of a divider leaf and includes a central body portion having a thickness greater than the thickness of the leaf and thinner elongate end portions which project outwardly from opposite ends of the body portion. The thick body portion maintains a spaced relation between the free ends of the divider leaves for inserting sheet material therebetween, and the thinner end portions provide guideway spaces into which an edge margin of a sheet may be slipped to insert a sheet between the divider leaves. Beveled exterior surfaces on the tab permit ease of insertion and removal of sheets in the device.

18 Claims, 10 Drawing Figures

INDEXING TAB FOR SORTING DEVICE

BACKGROUND AND SUMMARY OF THE INVENTION

This invention relates to an indexing tab for a sorting device, and more particularly to an indexing tab which may be secured to the free end of a divider leaf in such a device which provides a guideway into which an edge margin of a sheet may be slipped between adjacent divider leaves, and which has projecting end portions for ease of gripping by a user to spread the divider leaves if required.

Various sorting devices have been designed in the past having a plurality of divider leaves disposed in face-to-face relation, between which leaves sheet material may be slipped for sorting. Such previous devices, however, have required that a user manually grip an edge margin of the leaf or a tab attached to the leaf to physically separate edge, or end, margins of the dividers to provide a space into which a sheet may be slipped between adjacent leaves. Further, such prior devices have not provided convenient finger-engaging tab portions which are conveniently spaced from supportive structure and adjacent tabs to permit ease of engagement and operation by a user.

A general object of the present invention is to provide a novel tab for a sorting device which overcomes the above set-out disadvantages of previous designs in an economical and simple manner.

More specifically, an object of the present invention is to provide a tab for connection to an end of a divider leaf in a sorting device, which tab has a central body portion which is thicker than the divider leaf for maintaining a spaced relation between adjacent end margins of divider leaves in the device, and further has projecting end portions, thinner than the central body portion, which provide guideways into which edge margins of sheet material may be slipped between the divider leaves. Such construction allows a user to slip sheet material edgewise into the guideway provided by the tabs between adjacent divider leaves, without manually separating the leaves before such insertion.

Another object is to provide such a novel tab, in which the end portion thereof projects laterally of a side edge of its associated divider leaf and is spaced from the divider leaf and adjacent tabs in such a manner as to facilitate engagement by a user's finger if it is necessary to manually separate the divider leaves.

A still further object is to provide such a novel tab for use in a sorting device wherein the central body portion which is thicker than the divider leaf and the thinner projecting end portion are interconnected by a connecting portion which has beveled outer surfaces diverging on progressing from the end portion to the body portion. Such beveled connection portion further facilitates guiding and entry of a sheet between adjacent divider leaves.

Yet another object is to provide a novel tab which has a beveled rear edge margin along elongate common edges of the body and end portions facing the divider leaf, which converge to an edge which is thinner than the associated leaf, thus to facilitate removal of sheet material without catching an edge of the sheet as it is slid out from between adjacent divider leaves.

Another object is to provide a novel tab for a sorting device having a thick central body portion, an elongate, thinner, substantially planar end portion projecting outwardly from the body portion, and a recess formed in the body portion for receiving and end edge portion of the divider leaf whereby the leaf may be secured to the tab with the end edge of the divider leaf substantially coplanar with the end portion of the tab. Such construction further facilitates slipping of sheet material into and out of the space between adjacent divider leaves.

A still further object is the provision of novel deformable securing projections disposed within the recess of the body portion for securing such a tab to its associated divider leaf.

DRAWINGS

These and other objects and advantages will become more fully apparent as the following description is read in conjunction with the drawings, wherein.

DETAILED DESCRIPTION OF AN EMBODIMENT OF THE INVENTION

Figure 1:
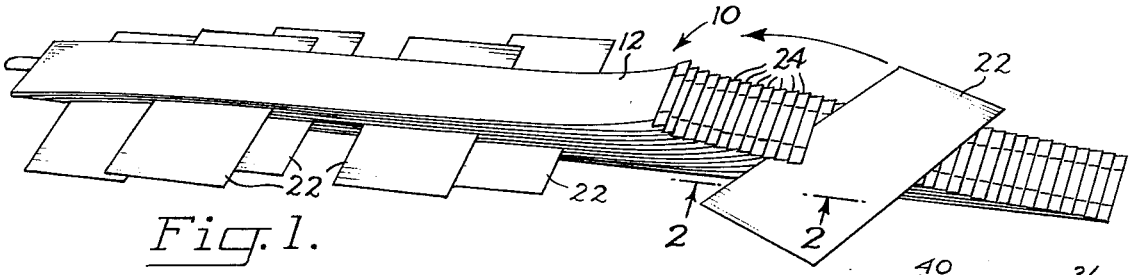
FIG. 1 is a perspective view of a sorting device including indexing tabs constructed according to an embodiment of the invention.
Figure 4:
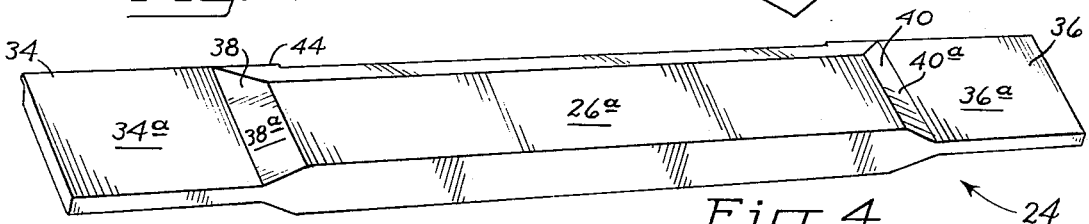
FIG. 4 is an enlarged perspective view of the top and front edge margin of a tab removed from the device.
Figure 5:
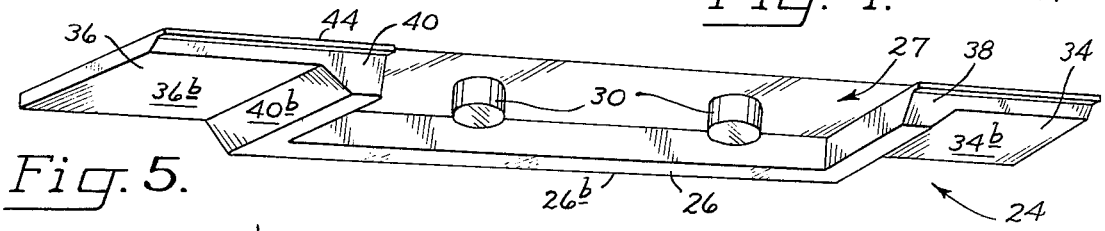
FIG. 5 is a perspective view of the tab, on the same scale as illustrated in FIG. 4, removed from the sorting device and taken from the bottom and rear edge margin of the tab.
Figure 2:
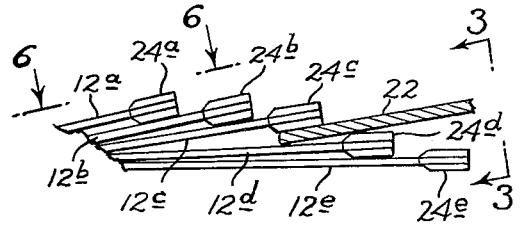
FIG. 2 is an enlarged side elevation view of a portion of the device taken generally along the line 2—2 in FIG. 1.

Referring to the drawings, and first more specifically to FIG. 1, at 10 is indicated generally a sorting device with indexing tabs constructed according to an embodiment of the invention. The sorting device includes a plurality of elongate, substantially planar divider leaves 12 disposed in face-to-face relationship. The rear set of ends (at the left in FIG. 1) are interconnected, while the outer, or free, ends of the leaves (at the right of FIG. 1 and as seen in FIG. 2) are unconnected to each other and are free to swing toward and away from each other in directions normal to the faces of the leaves. The free ends of the divider leaves are disposed in stair step positions relative to each other, with lower leaves extending longitudinally beyond upper leaves, as illustrated by the free set of ends of divider leaves 12*a*, 12*b*, 12*c*, 12*d*, 12*e* in FIG. 2. The basic construction and operation of such a sorting device is described in U.S. Pat. No. 1,797,355 to H. H. Martin.

Figures 6, 7, 8:
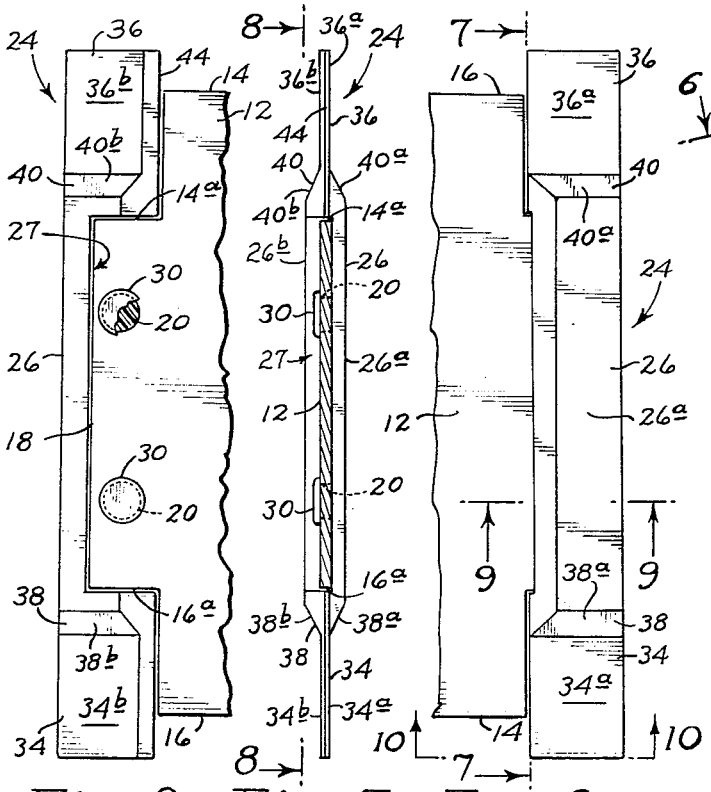
FIG. 6 is a top plan view of a tab and the outer end of its associated divider leaf taken generally along the line 6—6 in FIG. 2.
FIG. 7 is a cross-sectional view taken generally along the line 7—7 in FIG. 6.
FIG. 8 is a bottom view of the tab taken generally along the line 8—8 in FIG. 7.
Figure 9:
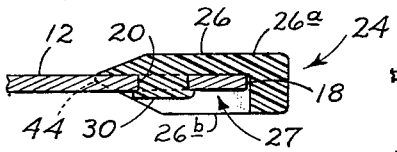
FIG. 9 is a cross-sectional view, on a somewhat enlarged scale, taken generally along the line 9—9 in FIG. 6.

Referring to FIGS. 6 and 8, it will be seen that the outer, or free, end of a divider leaf has opposed, substantially parallel side edges 14, 16 and an end edge 18 substantially normal to the side edges. The portion of leaf 12 adjacent end edge 18 is of reduced side-to-side dimension to produce edge margins 14*a*, 16*a* inset from side edges 14, 16, respectively. As is best seen in FIGS. 7, 8 and 9, this free end portion of the divider leaf adjacent end edge 18 is substantially planar and has a pair of bores, or openings, 20 formed therein.

The sorting device is of particular advantage for aid in sorting sheet material, as is illustrated in FIG. 1. The spaces between adjacent divider leaves may be given any desired designation, such as days of the week, days of the month, numbers in ascending or descending order, etc., and papers, or other sheet like material, slipped therebetween would be sorted into such classifications. Such papers are indicated generally at 22.

Figure 3:
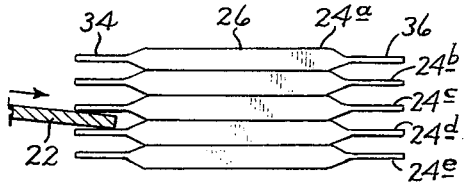
FIG. 3 is an end elevation view taken along the line 3—3 in FIG. 2.

Secured to the outer end of each of divider leaves 12 is an indexing tab 24. In FIGS. 2 and 3, tabs 24 connected to divider leaves 12*a*–12*e* have been given the numbers 24*a*–24*e*, respectively. Such tabs may be marked with desired indicia to designate the classification of sorting.

Describing an indexing tab 24 in detail and referring to FIGS. 4–10, it will be seen that the tab is a unitary element having an elongate, central body portion 26 which is substantially thicker than leaf 12 (see FIGS. 2, 7, 9 and 10). Referring to FIGS. 6 and 8 it will be seen that body portion 26 has a width somewhat greater than the distance which side marginal portions 14*a*, 16*a* project outwardly beyond the outer ends of side edges 14, 16.

Figure 10:
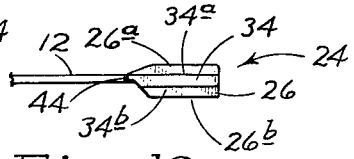
FIG. 10 is an end view taken generally along the line 10—10 in FIG. 6.

The underside of central body portion 26 has a recess 27 formed therein which has a length slightly greater than the distance between edge margins 14*a*, 16*a* and a width substantially equal to the distance which edge margins 14*a*, 16*a* project from remainder portions of the divider leaf. A pair of cylindrical, deformable projections 30 extend downwardly from body portion 26 into recess 27. The projections extend through bores 20 in leaf 12 and on being deformed into a mushroomed configuration as illustrated in FIG. 9 engage marginal edge portions of the leaf surrounding a bore 20 to tightly secure the tab to the free end of the leaf. With the tab thus secured to the free end of leaf 12, elongate, substantially planar opposite faces 26*a*, 26*b* of body portion 26 are spaced a distance outwardly from opposite planar face surfaces of leaf 12, as is best illustrated in FIGS. 7, 9 and 10.

Extending outwardly from opposite ends of central body portion 26 are elongate, substantially coplanar end portions 34, 36 having parallel opposed face surfaces 34*a*, 34*b* and 36*a*, 36*b*, respectively. Each of end portions 34, 36 is substantially thinner than central body portion 26, but is slightly thicker than leaf 12. The end portions 34, 36 extend outwardly from opposite ends of central body portion 26 intermediate opposite faces 26*a*, 26*b* of body portion 26 and are so positioned that when the tab is secured to leaf 12 end portions 34, 36 are substantially coplanar with the free end portion of leaf 12, as is best illustrated in FIGS. 7 and 10.

End portions 34, 36 are of such length that they extend outwardly from body portion 26 to produce a tab which has a total length somewhat greater than the width of leaf 12, whereby the opposite ends of end portions 34, 36 project beyond side edges 14, 16 of the divider leaf, as is illustrated in FIGS. 1, 6 and 8.

A connecting portion 38 of the tab having opposed surfaces 38*a*, 38*b* is interposed between end portion 34 and central body portion 26 and another connecting portion 40 having opposed surfaces 40*a*, 40*b* is interposed between end portion 36 and body portion 26. The opposite faces of connecting portions 38, 40 diverge on progressing from their associated end portion toward the central body portion of the tab. The diverging faces of the connecting portions provide gently sloping surfaces extending between the associated faces of the end portions and body portion of the tab.

Referring to FIGS. 4–6 and 8–10, it will be seen that the trailing edge margins of center body portion 26 and end portions 34, 36 are beveled to converge as they progress toward a common rear side edge 44 adjacent leaf 12. Common rear side edge 44 is somewhat thinner than leaf 12.

When the indexing tabs are secured to the free ends of leaves 12, as illustrated in FIGS. 2 and 3, the thicker central body portions 26 maintain a somewhat spaced-apart relationship between the free ends of the divider leaves. As is best seen in FIG. 3, since the end portions 34, 36 are thinner than central body portions 26, the end portions of adjacent indexing tabs are spaced apart vertically as well as horizontally to provide guideways into which an edge of a sheet may be slipped. In FIGS. 1, 2 and 3 a sheet 22 is shown being inserted edgewise between end portions of adjacent tabs 24*c*, 24*d*.

In operation, a sheet may be inserted between adjacent tabs for slipping between adjacent divider leaves by moving it edgewise into the guideway thus provided between the end portions of adjacent indexing tabs as seen in FIGS. 1–3. As the sheet is slipped edgewise into the guideway, it engages the beveled surfaces of connecting portions on the tabs. Continued insertion of the sheet acts to slightly lift the tab and free ends of the leaves overlying the sheet permitting passage of the sheet into the space between the divider leaves. If the material to be placed between adjacent divider leaves is too thick to pass conveniently between adjacent end portions of a pair of tabs when in their at-rest position, the opposed end portions of a tab projecting outwardly beyond opposite sides of a leaf may be conveniently grasped by a thumb and finger of a user to lift the leaf for insertion of material therebetween.

When it is desired to remove sheet material from the space between adjacent divider leaves, it may be merely slipped laterally from between the leaves, or it may be slipped longitudinally out between the free ends of the leaves. Should it be desired to slip them longitudinally from the free ends of the leaves, the beveled rear edge margins of the tabs permit the material to move smoothly outwardly between the free ends of the leaves without the edge of a sheet being caught by a projecting surface on either the top or bottom of the tab.

While a preferred embodiment of the invention has been described herein, it should be apparent to those skilled in the art that variations and modifications may be made without departing from the spirit of the invention.

It is claimed and desired to secure by Letters Patent:

1. A sorting device comprising a plurality of elongate divider leaves disposed in face-to-face relation and having an adjacent set of free ends mounted for swinging toward and away from each other to receive sheet material therebetween, and tabs secured to and projecting outwardly from said free ends of a pair of adjacent leaves, a tab on a leaf having a central body portion which is thicker than its associated leaf to maintain a spaced relationship between said free ends of the adjacent leaves and an end portion projecting outwardly from an end of said body portion transversely of the leaf and substantially parallel to the end edge of the leaf, said end portion being thinner than said body portion, with end portions of the tabs on adjacent leaves being spaced apart to define a guideway for insertion of sheet material between said free ends of the leaves.

2. The sorting device of claim 1, wherein the free end of said leaf is substantially planar, opposed face surfaces of said body portion of the tab lie in planes spaced a distance outwardly from opposite sides of the planes occupied by opposite faces of said end of the leaf, one face of the end portion of the tab lies in a plane intermediate one face of the leaf and the plane occupied by its associated face surface of the body portion, and rear marginal edge portions of said body portion and end portion facing in the direction of said leaf are beveled from said faces of the end portion and body portion toward said leaf surface along their combined length to an edge adjacent the leaf which is thinner than said leaf.

3. The sorting device of claim 1, wherein a tab further comprises means defining a recess in one face of said body portion for receiving said free end of its associated leaf with said end of the leaf and said end portion of the tab being substantially coplanar.

4. The sorting device of claim 3, wherein a tab further comprises securing means in said recess for securing said tab to said leaf.

5. A tab for a sorting device comprising an elongate body portion, end portions projecting longitudinally outwardly from opposite ends of said body portion, with said end portions being thinner than said body portion, and connecting portions intermediate said body and end portions, with one face of a connecting portion extending between and connecting one set of faces of the body portion and its associated end portion and the opposite face of the connecting portion extending between and connecting the opposite set of faces of the body portion and its associated end portion, with said faces of the connecting portion diverging on progressing from said associated end portion toward said body portion.

6. The tab of claim 5, wherein said end portions are substantially planar and are disposed in a substantially common plane intermediate opposed faces of said body portion.

7. The tab of claim 5, which further comprises means defining a recess in a face of said body portion for receiving an end margin of a divider leaf in a sorting device to which said tab is adapted to be connected.

8. The tab of claim 7, which further comprises securing means in said recess for securing said tab to a divider leaf.

9. The tab of claim 8, wherein said securing means comprises a deformable projection in said recess adapted for extending through an opening in a divider leaf to which the tab is to be connected and thereafter deformed to bend portions thereof over against edge margins of said opening.

10. The tab of claim 5, wherein elongate edge margins of said body portion and an end portion of the tab are substantially aligned and coplanar, and said edge margin portions are beveled to produce a thinner section along a common side edge for said tab.

11. In a sorting device including a plurality of elongate divider leaves disposed in face-to-face relation and having an adjacent set of free ends mounted for swinging toward and away from each other to receive sheet material therebetween, with a free end of a leaf being substantially planar, an indexing tab connected to the free end of a leaf, said tab comprising a main body portion and an elongate end portion projecting outwardly from an end of said body portion transversely of the leaf and substantially parallel to the end edge of the leaf, said body portion having a thickness greater than the thickness of its associated leaf and said end portion being thinner than said body portion, with opposed face surfaces of said body portion of the tab lying in planes spaced outwardly from opposite sides of the planes occupied by opposite faces of said end of the leaf and said end portion of the tab being substantially coplanar with said end of the leaf, and a connecting portion intermediate said body and end portion, with one face of the connecting portion extending between and connecting one set of faces of the end portion and body portion and the opposite face of the connecting portion extending between and connecting the opposite set of faces of the body and end portion, said faces of the connecting portion diverging on progressing from said end portion toward said body portion.

12. In a sorting device including a plurality of elongate divider leaves disposed in face-to-face relation and having an adjacent set of free ends mounted for swinging toward and away from each other to receive sheet material therebetween, an indexing tab connected to the free end of a leaf, said tab comprising a main body portion, an elongate end portion projecting outwardly from an end of said body portion transversely of the leaf and substantially parallel to the end edge of the leaf, said body portion having a thickness greater than the thickness of its associated leaf and said end portion being thinner than said body portion, means defining a recess in one face of said body portion for receiving said free end of its associated leaf with said end of the leaf and said end portion of the tab being substantially coplanar, the end of a leaf received in said recess having an opening defined therein, and said tab further comprises a deformable projection extending from said body portion through said opening with portions of said projection being bent over against marginal edges of said opening to secure said tab to said leaf.

13. In a sorting device including a plurality of elongate divider leaves disposed in face-to-face relation and having an adjacent set of free ends mounted for swinging toward and away from each other to receive sheet material therebetween, an indexing tab connected to the free end of a leaf, said tab comprising a main body portion, an elongate end portion projecting outwardly from an end of said body portion transversely of the leaf and substantially parallel to the end edge of the leaf, said body portion having a thickness greater than the thickness of its associated leaf and said end portion being thinner than said body portion, and another elongate end portion which is thinner than said body portion projecting outwardly from the end of the body portion opposite said first-mentioned end portion, transversely of the leaf and substantially parallel to said free end of the leaf.

14. The sorting device of claim 13, wherein said first-mentioned and said other end portions are substantially coplanar with a marginal end portion of said leaf and project laterally outwardly beyond opposite side margins of said leaf.

15. A sorting device comprising a plurality of elongate divider leaves disposed in face-to-face relation and having an adjacent set of free, substantially planar ends mounted for swinging toward and away from each other to receive sheet material therebetween, and tabs secured to and projecting outwardly from said free ends of a pair of adjacent leaves, a tab on a leaf having a central body portion which is thicker than its associated leaf, with opposed face surfaces of said body portion of a tab occupying planes spaced outwardly from opposite sides of the planes occupied by opposite faces of said end of its associated leaf to maintain a spaced relationship between said free ends of the adjacent leaves, an end portion projection outwardly from an end of said body portion transversely of the leaf and substantially parallel to the end edge of the leaf, said end portion being thinner than said body portion and substantially coplanar with said end of the leaf, with end portions of the tabs on adjacent leaves being spaced apart to define a guideway for insertion of sheet material between said free ends of the leaves, and a connecting portion intermediate said body and end portion, with one face of the connecting portion extending between and connecting one set of faces of the end portion and body portion and the opposite face of the connecting portion extending between and connecting the opposite set of faces of the body and end portion, said faces of the connecting portion diverging on projecting from said end portion toward said body portion.

16. In a sorting device including a plurality of elongate divider leaves disposed in face-to-face relation and having an adjacent set of free ends mounted for swinging toward and away from each other to receive sheet material therebetween, an indexing tab connected to the free end of a leaf, said tab comprising a main body portion and an elongate end portion projecting outwardly from an end of said body portion transversely of the leaf and substantially parallel to the end edge of the leaf, said body portion having a thickness greater than the thickness of its associated leaf, with opposed face surfaces of said body portion of the tab occupying planes spaced outwardly from opposite sides of the planes occupied by opposite faces of said end of the leaf, and said end portion being substantially planar, thinner than said body portion, and substantially coplanar with said end of the leaf.

17. The sorting device of claim 16, wherein said tab further comprises means defining a recess in one face of said body portion for receiving said free end of its associated leaf with said end of the leaf and said end portion of the tab being substantially coplanar.

18. The sorting device of claim 17, wherein said tab further comprises securing means in said recess for securing said tab to said leaf.

* * * * *